United States Patent [19]

Isabel

[11] 4,340,102

[45] Jul. 20, 1982

[54] GOLF CLUB BAGS

[76] Inventor: John R. Isabel, 15 Victoria Ave., Grays, Essex, England

[21] Appl. No.: 223,106

[22] Filed: Jan. 7, 1981

[30] Foreign Application Priority Data

Jan. 7, 1980 [GB] United Kingdom ..... 8000436

[51] Int. Cl.[3] ..... A63B 55/00

[52] U.S. Cl. ..... 150/1.5 R; 206/315 R; 206/443; 273/32 E

[58] Field of Search ..... 150/1.5 R, 1.5 B, 1.5 C; 206/315 R, 443; 273/32 E

[56] References Cited

U.S. PATENT DOCUMENTS

| | | | |
|---|---|---|---|
| 3,503,518 | 3/1970 | Black | 150/1.5 R |
| 3,534,795 | 10/1970 | Wiedenmeier | 150/1.5 R |
| 4,200,131 | 4/1980 | Chitwood et al. | 150/1.5 R |
| 4,241,774 | 12/1980 | Pell | 150/1.5 R |

FOREIGN PATENT DOCUMENTS

| | | | |
|---|---|---|---|
| 2220493 | 2/1973 | Fed. Rep. of Germany | 206/315 R |

*Primary Examiner*—Joseph Man-Fu Moy
*Assistant Examiner*—Gary E. Elkins
*Attorney, Agent, or Firm*—Emory L. Groff, Jr.

[57] ABSTRACT

A golf club bag has a head (20) with apertures to accommodate a set of inverted golf clubs. Centrally of the apertures is a curved elongate aperture (5) to accommodate seven inverted irons in a row. The head (20) has shaped elongated recesses (6–12) therein extending transversely of the aperture (5) to seat the blade of each of the seven irons so as to inhibit or prevent rotational movement of each of the irons. The bottom of the bag has retaining means (80) to hold the shafts of the seven inverted irons in an arcuate fan-like arrangement.

The golf club bag when fully loaded enables a proper and convenient balance and weight distribution to be achieved and maintained.

24 Claims, 18 Drawing Figures

FIG. 6.
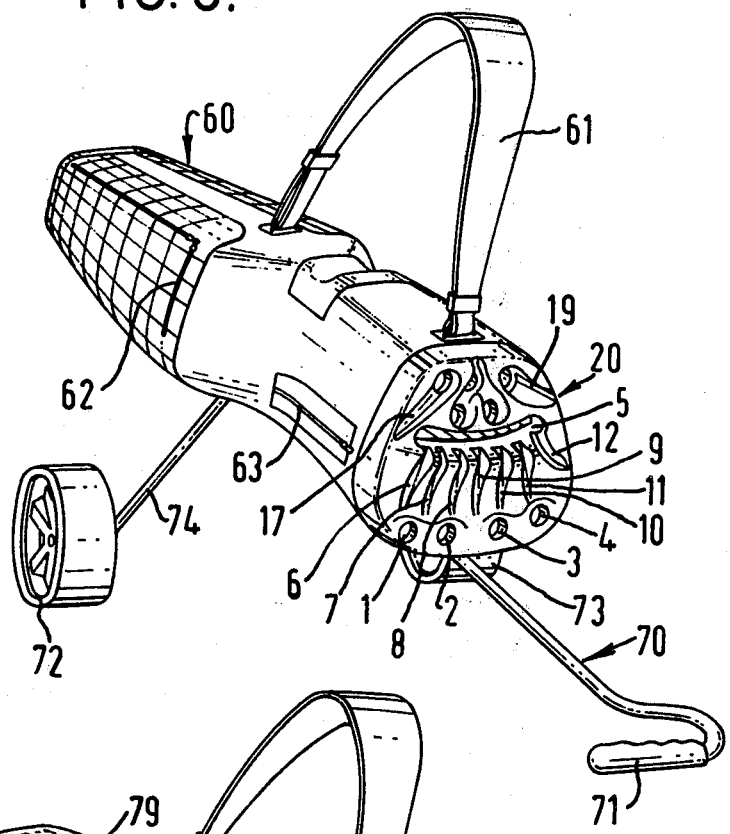
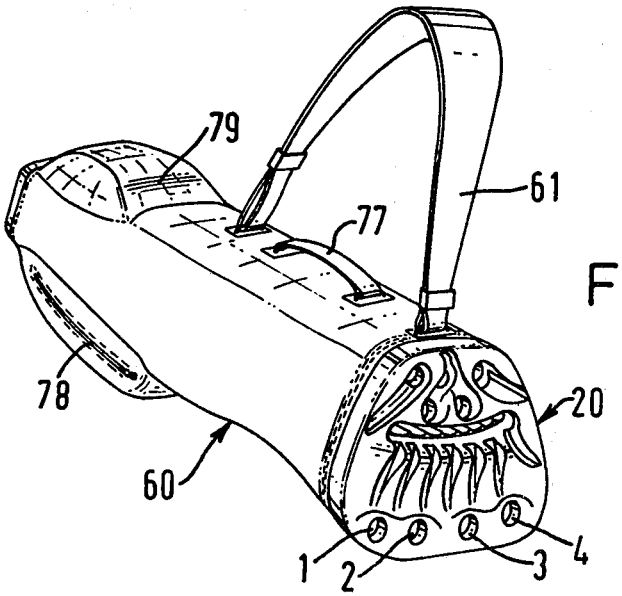
FIG. 12.

GOLF CLUB BAGS

BACKGROUND OF THE INVENTION

The present invention relates to a golf club bag having a head comprising apertures therein to accommodate a set of inverted golf clubs.

DESCRIPTION OF PRIOR ART

Golf club bags having apertured heads to accommodate a set of inverted golf clubs are known but are not entirely satisfactory because the general random or uniform distribution of the apertures in the head allow the various golf clubs to be loosely and randomly packed in the bag. Consequently the fully or substantially fully loaded bag will be cumbersome and unbalanced for the player or other person to carry.

The primary object of the present invention is to enable a golf club bag to be packed and unpacked easily and reliably and when fully or substantially fully loaded the arrangement is closely packed and the balance and weight distribution are substantially predeterminable and unvarying. This is achieved by constructing the head of the bag so that the seven irons will be disposed and maintained in a predetermined position in a central portion of the bag, retaining means being provided in the bottom of the bag to ensure that the predetermined distribution of the said irons will be maintained. Advantageously at least some of the remaining golf clubs, preferably all, will likewise be disposed and maintained in predetermined positions in the bag. A proper balance and weight distribution of a substantially fully loaded golf bag are important considerations where such a bag has to be carried by a player for any length of time so as to minimise discomfort and fatigue.

SUMMARY OF THE INVENTION

According to the invention I provide a golf club bag having a head comprising apertures therein to accommodate a set of inverted golf clubs in a prearranged fashion, the apertures including centrally of the other apertures a curved elongate aperture to accommodate seven inverted irons in a row and the head having shaped elongate recesses therein extending transversely of the elongate aperture to seat the blade of each of the said seven irons so as to inhibit or prevent rotational movement of each said iron, the bottom of the bag having retaining means to hold the shafts of the seven inverted irons in an arcuate fan-like arrangement. Desirably the said shaped elongate recesses extend in the same general direction and preferably the elongate recesses are arranged approximately radially. Preferably the said retaining means in the bottom of the golf club bag comprises an arcuate tubular arrangement which may take the form of an arcuate tube comprising circular hollow sub-sections to accommodate the respective shafts, the said hollow sub-sections being linked together, e.g. by waisted portions.

In an expedient form of the invention the said curved elongate aperture in the head is disposed intermediate of a row of circular apertures in the head for the shafts of four inverted woods and a row of circular apertures in the head for the shafts of an inverted pitching wedge, putter and sand wedge. Preferably the aperture for the putter is disposed between the respective apertures for the pitching wedge and sand wedge. Preferably each said row of circular apertures is arcuately arranged. The head may contain shaped recesses to seat the blades of the pitching wedge and sand wedge so as to inhibit or prevent rotational movement of each of the said wedges. In this preferred form of the invention it is desirable that each said shaped elongate recess in the head extending transversely of the said elongate aperture should extend in a general direction towards the apertures for the woods. Also the head may contain a shaped recess to seat the blade of the putter so as to inhibit or prevent rotational movement of the putter. Tubes, preferably of metal, e.g. aluminum, or of plastics material, e.g. of polyvinyl chloride, may be provided in the bag to accommodate the shafts of various golf clubs. They may extend from the bottom of the bag to the head of the bag or they may extend only to a limited portion of the length of the bag. With regard to the seven irons disposed in the middle of the bag the said preferred arcuate tubular arrangement in the bottom of the bag may extend from the bottom of the bag to a position less than half the length of the bag, for instance to approximately a third of the length of the bag and if desired an additional retaining means for the seven inverted irons, for example a web of material, may be disposed between the top end of the said tubular arrangement and the head of the bag.

In the preferred form of bag embodying the invention where the elongate aperture for the seven irons is disposed in the head between a row of 4 apertures in the head and a row of three apertures in the head for the two wedges and the putter, two spare circular apertures in the head may be provided, preferably between the row of wedges and putter on the one hand and the curved elongate aperture on the other hand, to accommodate two inverted spare irons and/or golf balls. Tubes in the bag to accommodate the shafts of the spare irons and/or the golf balls will normally be provided.

BRIEF DESCRIPTION OF THE DRAWINGS

By way of example two embodiments of the invention will now be described in detail with reference to the accompanying drawings. The drawings relating to the first embodiment are as follows:

FIG. 6 is a perspective view of a golf bag provided with the head shown in FIG. 1 and a trolley therefor.

DESCRIPTION OF PREFERRED EMBODIMENT

Figure 1:
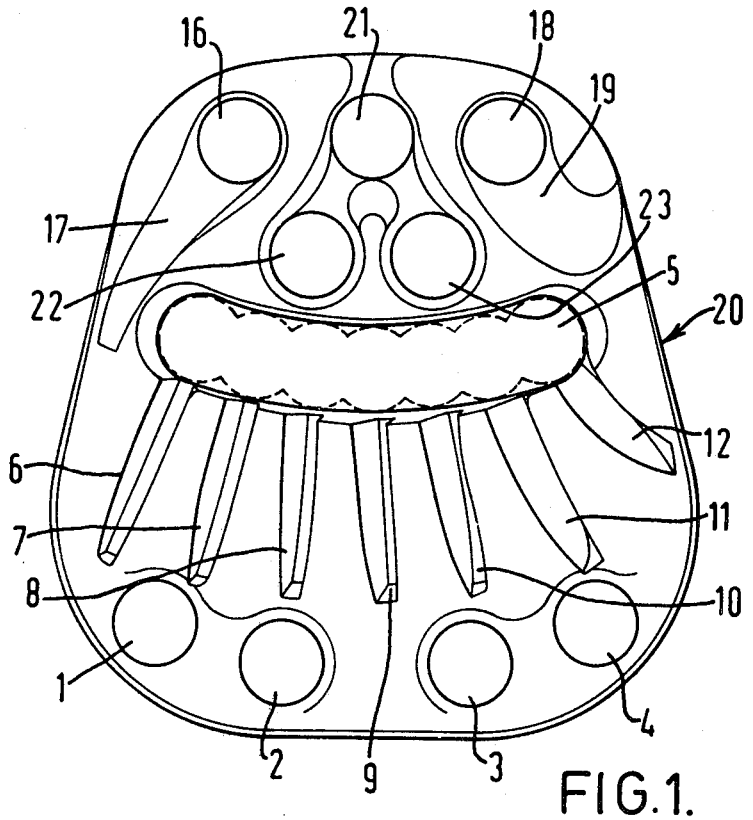
FIG. 1 is a plan view of a head of a golf bag embodying the invention.

FIG. 1 shows a golf bag head 20 which is a one piece moulding, for instance of wood or hard plastics material. If desired the head may be formed of a medium density rubber or a resilient polymeric material such as resilient polyvinyl chloride to give a flexible yet resilient component. If the head are provided apertures to accommodate a set of golf clubs as follows.

Circular apertures 1, 2, 3 and 4 for four individual woods; an elongate aperture 5 for seven individual irons with their heads arranged alongside each other in an arcuate row; a circular aperture 16 for a pitching wedge; a circular aperture 18 for a sand wedge; a circular aperture 21 for a putter and finally circular apertures 22 and 23 to accommodate golf balls or spare irons or other items. Apertures 22 and 23 are optional but it is generally more convenient for them to be provided.

It is especially important that the irons accommodated by the elongate aperture 5 should be able to rest securely therein in a close packed arrangement and consequently shaped recesses 6, 7, 8, 9, 10, 11 and 12 in the top 24 of the head 20 are provided to retain the heads of the individual irons in predetermined desired positions so that the balance and distribution of these irons will not be disturbed under normal conditions. The shaped recesses 6 to 12 specifically cater for low number irons to be positioned to the left (as seen in FIG. 1) with the higher numbers to the right in logical arithmetic sequence. It is also advantageous to provide correspondingly shaped recesses 17 and 19 as shown in FIG. 1 to retain the pitching wedge in aperture 16 and the sand wedge in aperture 18 respectively. With regard to the aperture 21 for the putter a suitably shaped recess could be provided (although now shown); where balls are provided in the top of apertures 22 and 23 the head of the putter is suitably retained in position between the golf balls seated in apertures 22 and 23. If apertures 22 and 23 are not present a suitably shaped recess for the head of the putter will advantageously be provided.

Figure 2:
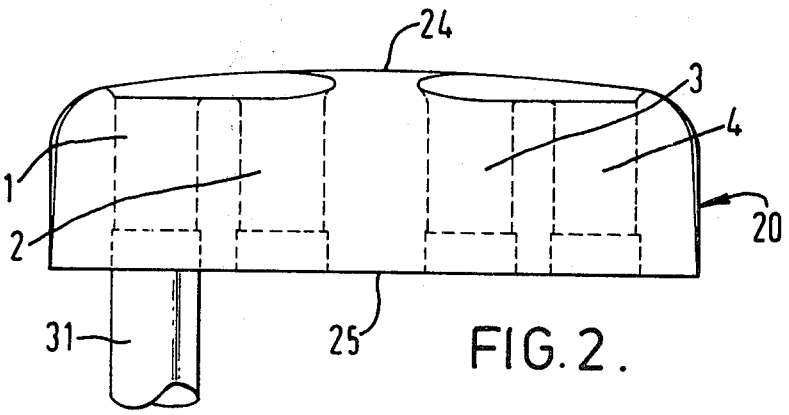
FIG. 2 is a front elevation of the golf bag head shown in FIG. 1.

In FIG. 2 a tube 31, which may for instance be of metal such as aluminum or of a plastics material such as polyvinyl chloride, is seated in the underside 25 of the head 20 to retain the shaft of the wood held in aperture 1. Other tubes of a similar kind are shown in FIGS. 3, 4 and 5 and will be described below.

With regard to the woods in apertures 1, 2, 3 and 4 no shaped recesses are provided in the head 20 to accommodate the respective golf club heads because the heads normally project well beyond the top of the head 20 and rotational movement of an individual wood will not materially affect the balance and weight distribution of the fully loaded golf club because woods are lighter and less numerous than the irons. Furthermore it is normal practice to provide each wood with an individual cloth or waterproof cover and such will arrest or inhibit rotational movements of the individual woods seated in the corresponding apertures 1, 2, 3 and 4.

Figure 5:
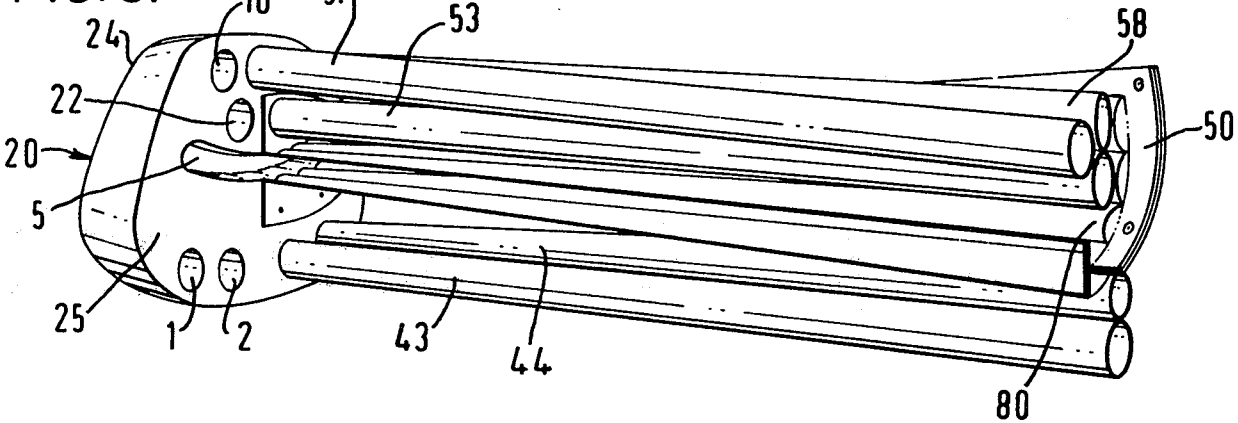
FIG. 5 is a cutaway view of the golf bag head shown in FIG. 1, and part of a tubular assembly.

The tubular arrangement adjacent the head 20 is shown in detail in FIG. 5. Sleeves designated 43 and 44 accommodate the shafts of woods located in apertures 3 and 4 respectively, and sleeves designated 51 and 53 and 58 accommodate the shafts of the putter, spare iron (if provided) and sand wedge located in apertures 21, 23 and 18 respectively. Although not shown for clarity similar tubes are provided for all the golf clubs at a site adjacent to the head with the exception of the irons accommodated by the aperture 5. The various tubes are contained by a covering material 50, for instance of suitable plastics material.

Figure 3:
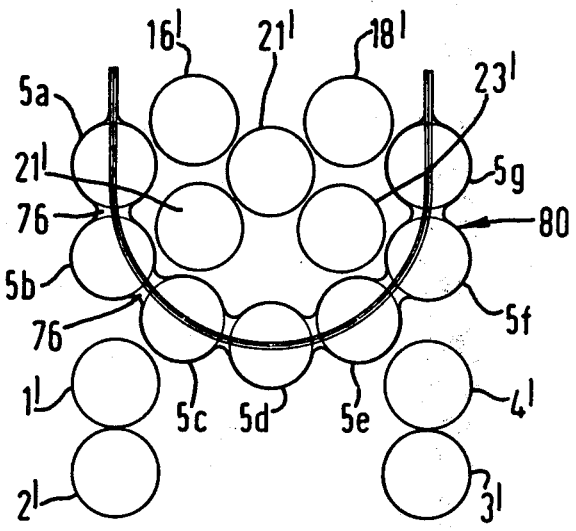
FIG. 3 is a schematic plan view of a tubular arrangement at the bottom of the golf bag.
Figure 4:
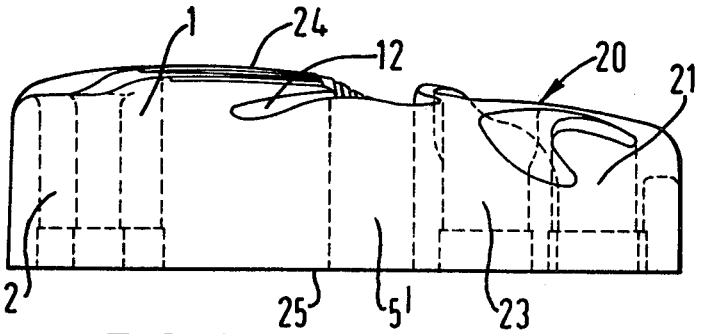
FIG. 4 is a side elevation of the golf bag head shown in FIG. 1.

FIG. 3 shows the construction of the bottom of the golf bag. Apertures 1', 2', 3', 4', 16', 18', 21', 22' and 23' represent the bottoms of retaining tubes for the shafts of individual golf clubs accommodated by apertures 1, 2, 3, 4, 16, 18, 21, 22 and 23 respectively in the bag head 20. To hold the bottoms of the shafts of the irons accommodated in the aperture 5 in the bag head 20 an arcuate tube 80 is provided comprising circular hollow sub-sections **5*a*, 5*b*, 5*c*, 5*d*, 5*e*, 5*f*, 5*g* linked together by waisted portions 76. It is thereby ensured that the irons in aperture 5** maintain their central disposition throughout the length of the bag.

The complete bag 60 is shown in FIG. 6. The outer cover of the bag may be made of suitably tough flexible plastics material and is conveniently provided with zipper openings 62 and 63. The golf bag may be carried by the handle 61 provided or it can be pulled on a trolley 70 provided with a pulling handle 71, wheels 72 and 73 and aluminum splayed legs 74.

The means for retaining the irons in the elongate aperture 5 as particularly described and illustrated is consistent with a logical arrangement in relation to function from woods through irons to putter and pitching irons. The provision of elongate aperture 5, shaped recesses 6, 7, 8, 9, 10, 11, 12 and the arcuate tube 80 with hollow sub-sections **5*a*, 5*b*, 5*c*, 5*d*, 5*e*, 5*f*, 5*g* allows for the accommodation of seven irons at any one time in an arcuate arrangement. Only one iron can be withdrawn or replaced at a time. It is of particular significance that it keeps the body of the bag 60 as narrow as possible and, therefore, as comfortable to carry as is possible within the context of the arrangement of golf clubs in the bag head 20**, and at the same time there is provided a concise and logical arrangement of golf clubs for convenient withdrawal and replacement by a player.

Figure 11:
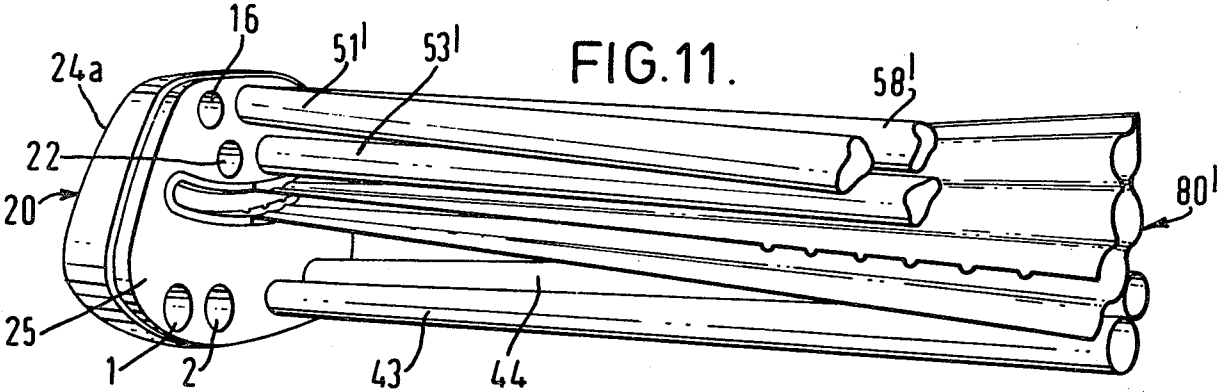
Figure 7:
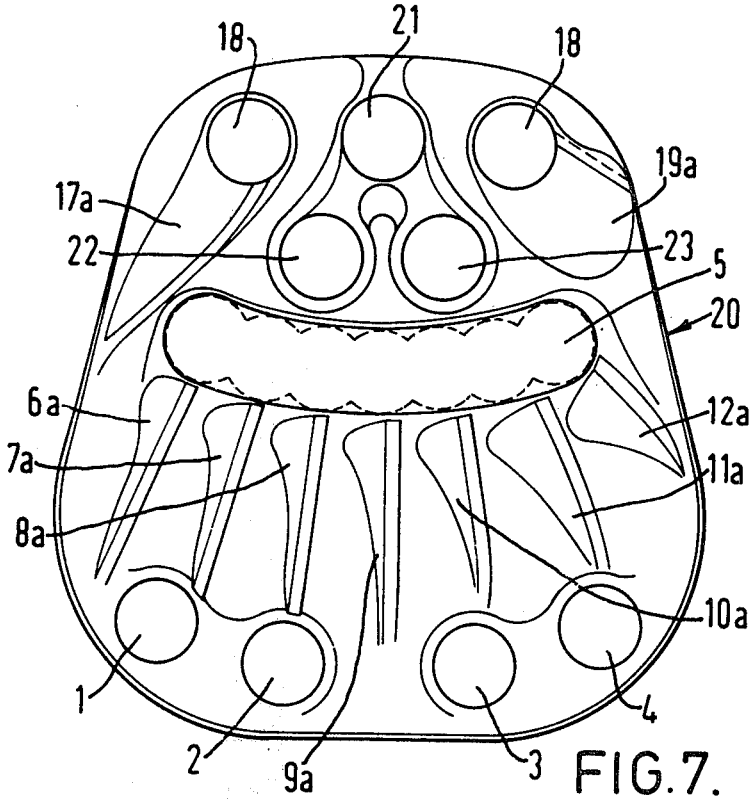
Figure 8:
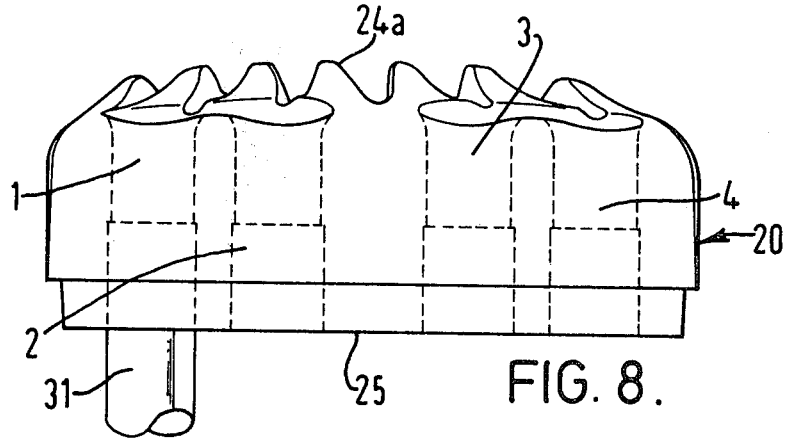
Figure 9:
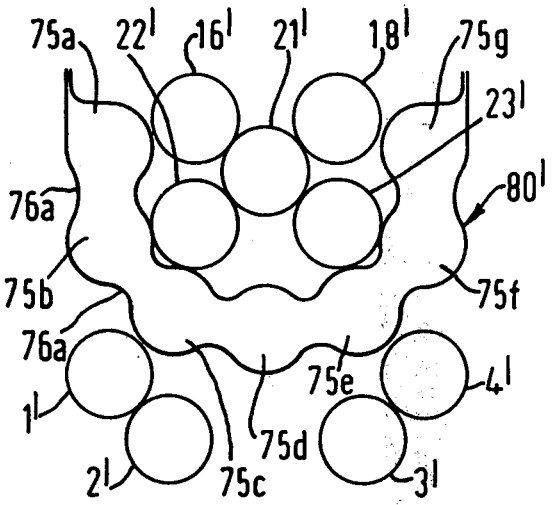
Figure 10:
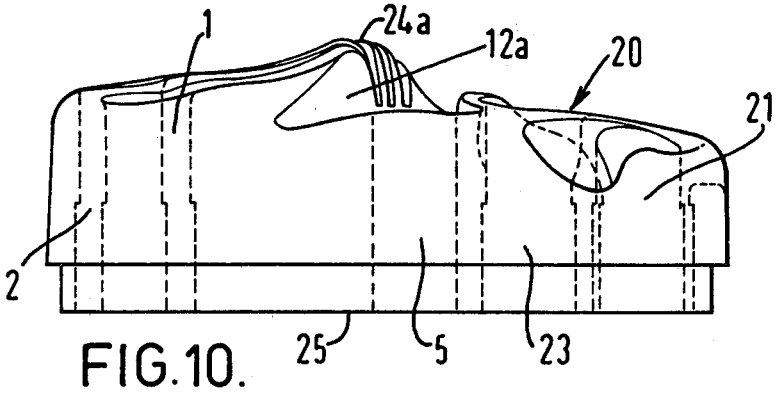
Figure 14:
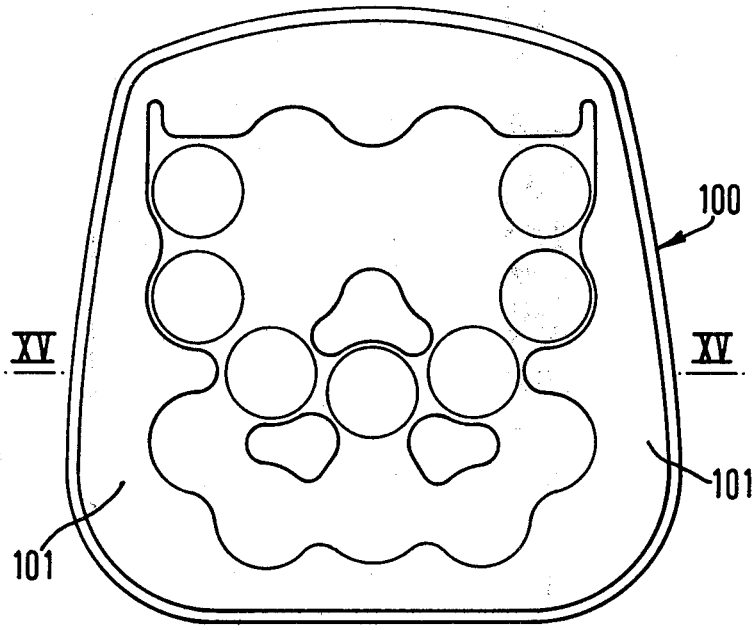
Figure 15:
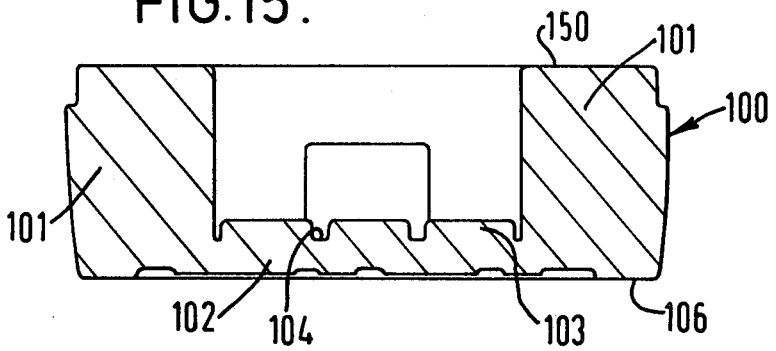
Figure 16:
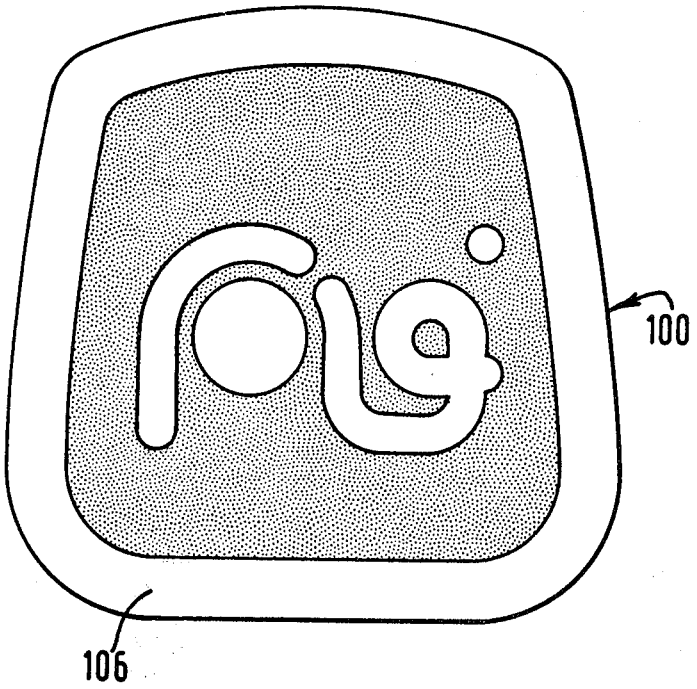

The drawings relating to the second embodiment are as follows:

FIG. 7 is a plan view of a head of a golf bag embodying the invention,

FIG. 8 is a front elevation of the golf bag head shown in FIG. 7,

FIG. 9 is a schematic plan view of a tubular arrangement at the bottom of the golf bag, FIG. 10 is a side elevation of the golf bag head shown in FIG. 7, FIG. 11 is a cutaway view of the golf bag head shown in FIG. 7, and part of a tubular assembly, FIG. 12 is a perspective view of a golf bag provided with the head shown in FIG. 7, FIGS. **13*a*–13*c* represent cross-sections of the arcuate tube shown in FIG. 9, the cross-sections shown being at the head, middle and base respectively of the golf bag shown in FIG. 12, FIG. 14 is a plan view of the base moulding of the golf bag of FIG. 12 showing the contoured or relief configuration of the base moulding, FIG. 15 is a section along line XV—XV of FIG. 14, and FIG. 16 is a plan view of the outside of the base of the golf bag of FIG. 12**.

FIGS. 7 to 12 illustrative of the second embodiment are analogous to FIGS. 1 to 6 illustrative of the first embodiments. A similar close pack arrangement is shown although in FIG. 7 the recesses shown in the top **24*a* of the head 20 and denoted by 6*a*, 7*a*, 8*a*, 9*a*, 10*a*, 11*a* and 12*a* are a little different to those denoted by 6, 7, 8, 9, 10,11 and 12 in the top 24 of the head 20 as seen in FIG. 1. In FIGS. 8 and 10 the top 24*a* of the head 20 shows a castellated configuration in contrast to the smoother outline shown in FIGS. 2 and 4. In FIG. 9 there is shown an arcuate tube 80' comprising curved hollow sub-sections 75*a*, 75*b*, 75*c*, 75*d*, 75*e*, 75*f*, 75*g* linked together by waisted portions 76*a*; the sub-sections 75*a*–75*g* are not so circular as the corresponding sub-sections 5*a*, 5*b*, 5*c*, 5*d*, 5*e*, 5*f* and 5*g* in FIG. 2 and the waisted portions 76*a* of FIG. 9 are not so attenuated as those denoted by 76 in FIG. 3**.

FIG. 11 is similar to FIG. 5. The tubes 51', 53' and 58' corresponding to the tubes 51, 53 and 58 of FIG. 5 show non-circular rather than circular sections and a covering material corresponding to covering material 50 of FIG. 5 is not shown in FIG. 11.

The golf bag of FIG. 12 is not mounted on a trolley as shown in FIG. 6, but shows an additional handle 77. The zipper openings 78, 79 are located in different positions to those shown in FIG. 6 and denoted by 62, 63.

Figure 13A:
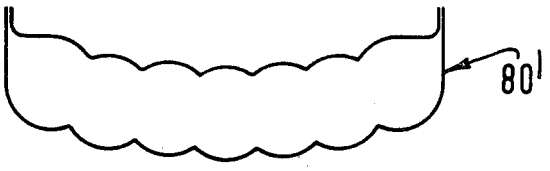
Figure 13B:
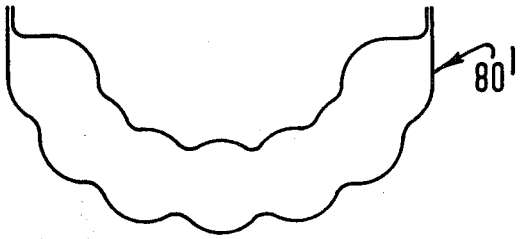
Figure 13C:
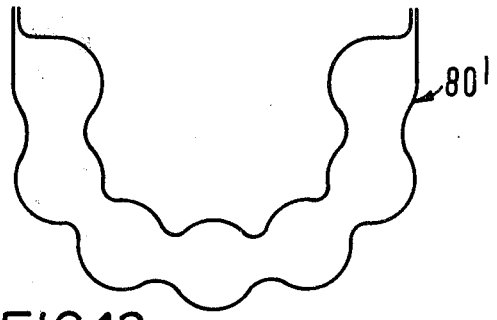

FIGS. 13*a*–13*c* have been introduced to show the change in shape of the arcuate tube 80' from the top to the bottom of the golf club bag 60. The arcuate tube 80' at its base (FIGS. 13*c* and 9) comprise seven hollow sub-sections 75*a*–75*g* in communication with one another through waisted portions 76*a*. The sub-sections 75*a*–75*g* are so shaped and dimensioned as to prevent hand grips on the handles of inverted irons accommodated therein from becoming too congested at the bottom of the arcuate tube 80'. Thus the tube 80' changes progressively in shape from an approximately semi-annular form at the base of the bag (FIG. 13*c*) to the middle section of the bag (FIG. 13*b*) and from there to the head of the bag (FIG. 13*a*) where an arcuate shape is shown of very much larger radius of curvature than semi-circular.

Finally with reference to the second embodiment FIGS. 14 to 16 depict a golf bag-base moulding denoted by 100. As FIG. 15 shows, thick portions 10 are joined by an attenuated portion 102, which latter comprises studs 103 separated by channels 104. The upper edge of the base moulding is denoted by 105 and the bottom of the base moulding by 106. If reference is made to FIGS. 7 and 9 it will be appreciated that A represents raised portions which define between them valley portions to accommodate at lower levels the bottoms of the tubes shown in FIG. 9. Thus level B which is above the level C is for the bottom of the tube 80' whereas the level C is for the bottoms of the individual tubes 1', 2', 3', 4', 16', 18', 21', 22' and 23'. Conveniently tubes 1', 2', 3' and 4' will be arranged always to be nearer the ground than the other tubes when being transported. Ideally, the bag will be pulled on a golf trolley so that the horizontal relationship of the head of the bag to the ground will not change under normal conditions.

It will be seen from FIGS. 13*a*–13*c* that the arcuate tube 80' is of uniform width throughout its length. In this particular embodiment the uniform width will not exceed $6\frac{3}{4}$ inches. With this shape and dimensional condition I find that the layout of the irons in the golf club bag head is neat and concise as possible. By keeping the width of the bag to a minimum the bag will be more comfortable to carry than a golf club bag which is much wider.

With regard to both embodiments it may be mentioned that all tubes, including the arcuate tube (80 or 80') may be fixed to the head and/or base by flue, staples, rivets or other convenient fastening means so as to maintain at all times a proper relationship of the head to the whole of the tube assembly and the base. All of the boids between the tubes may be packed with polystyrene of other packing material.

With respect to both embodiments the drawings illustrate a golf bag suitable for a right-handed golfer but if a design were required for a left-handed golfer the same principles would be applicable and a correspondingly modified arrangement would be required and such adjustment would not be difficult to make. In FIG. 7 the defined face of each of the recesses 6*a*–12*a* on the left as seen in FIG. 7 for each recess is designed to accept irons with different face angles. The maximum angles that each of these recesses is designed to accept are as follows:

6*a*—22°
7*a*—26°
8*a*—30°
9*a*—34°
10*a*—38°
11*a*—42°
12*a*—46°

The shaped side of the recesses in the head for the sand wedge and pitching wedges are designed to take a pitching wedge with a face angle of up to 52° and a sand wedge with a face angle of up to 57°.

With particular reference to the two illustrated embodiments it will be understood that the concise nature of the golf club bag head relative to the whole tube assembly including the arcuate tube is most important. The layout of the recesses for the putter and wedges is also important in that the area between the two wedges is of just sufficient width to accommodate the heads of variously shaped putters. The constructions depicted allow for a neat arrangement of golf clubs affording ease of selection and replacement with an overall bag width that should allow the whole to be carried comfortably; additionally the substantially "in line" arrangement of the tubes for the woods makes for a flat back to the bag so that the position of the head of the bag is substantially always maintained when the bag is in place on a trolley.

I claim:

1. A golf club bag comprising a head defining apertures to accommodate a set of inverted golf clubs in a pre-arranged fashion, and a bottom comprising shaft-retaining means to hold the shaft of seven inverted irons in an arcuate fan-like arrangement, one of the apertures in the head being of curved elongate shape and being arranged to accommodate the seven inverted irons in a row and being disposed centrally of the other apertures in the head to provide a balanced weight distribution to said bag, the head also defining shaped elongate recesses extending transversely of the said curved elongate aperture to seat the blade of each of the seven irons in order to resist any rotational movement of each said iron.

2. A golf club bag according to claim 1, wherein the said shaped elongate recesses extend in the same general direction.

3. A golf club bag according to claim 1, wherein the said shaped elongate recesses are arranged substantially radially.

4. A golf club bag according to claim 1, wherein the said bottom shaft-retaining means comprises an arcuate tube comprising circular fallow sub-sections to accommodate the respective shafts of the seven irons and waisted portions linking the said hollow sub-sections together.

5. A golf club bag according to claim 1, wherein the head defines a row of circular apertures for the shafts of four inverted woods to one side of the said curved elongate aperture and to the other side of the said curved elongate aperture a row of circular apertures for the shafts of an inverted pitching wedge, putter and sand wedge.

6. A golf club bag according to claim 5, wherein each said row of circular apertures is arcuate.

7. A golf club bag according to claim 5, wherein the aperture for the putter is disposed between the respective apertures for the pitching wedge and sand wedge and the head defines shaped recesses to seat the blades of the pitching wedge and sand wedge so as to resist any rotational movement of each of the said wedges.

8. A golf club bag according to claim 5, wherein each said shaped elongate recess in the head extending transversely of the said elongate aperture extends in a general direction towards the apertures for the woods.

9. A golf club bag according to claim 5, wherein the head defines a shaped recess to seat the blade of the putter so as to resist any rotational movement of the putter.

10. A golf club bag according to claim 1, which includes tubes to accommodate the shafts of various golf clubs.

11. A golf club bag according to claim 10, which includes tubes extending from the bottom of the bag to the head of the bag.

12. A golf club bag according to claim 10, which includes extending only to a limited portion of the length of the bag.

13. A golf club bag according to claim 1, wherein the said arcuate tubular arrangement in the bottom of the bag extends from the bottom of the bag to a distance of less than a half the length of the bag.

14. A golf club bag according to claim 1, wherein the said arcuate tubular arrangement in the bottom of the bag comprises an arcuate tube extending from the bottom of the bag to the head of the bag.

15. A golf club bag according to claim 14, wherein in cross-section the arcuate tube shows seven enlarged hollow sections adjacent one another and spaced apart from one another by reduced hollow sections.

16. A golf club bag according to claim 14, wherein the cross-section of the arcuate tube changes progressively in shape from a substantially semi-annular shape at the bottom of the bag to a shape at the head of the bag which is arcuate and of a larger radius of curvature than semi-circular.

17. A golf club bag according to claim 1, wherein the base of the bag shows an internal relief configuration to accommodate the bottoms of tubes to house the shafts of inverted golf clubs.

18. A golf club bag according to claim 17, wherein the base of the bag shows an internal stepped configuration to accommodate at different levels the bottoms of tubes to house shafts of inverted golf clubs.

19. A golf club bag according to claim 1 which has been loaded with a set of inverted golf clubs.

20. A golf club bag comprising a head defining apertures to accommodate a set of inverted golf clubs in a pre-arranged fashion, and a bottom comprising shaft-retaining means to hold the shafts of seven inverted irons in an arcuate fan-like arrangement and shaft-retaining means to hold the shafts of other inverted golf clubs, one of the apertures in the head being of curved elongate shape and being arranged to accommodate the seven inverted irons in a row and being disposed centrally of the other apertures in the head, which other apertures comprise a row of circular apertures in the head for the shafts of four inverted woods to one side of the curved elongate aperture and to the other side of the said curved elongate aperture a row of circular apertures for the shafts of an inverted pitching wedge, putter and sand wedge, the head also defining shaped elongate recesses extending transversely of the said curved elongate aperture to seat the blade of each of the seven irons in order to resist any rotational movement of each said iron.

21. A golf club bag according to claim 20, wherein the head defines shaped recesses to seat the blades of the pitching wedge and sand wedge so as to resist any rotational movement of each of the said wedges.

22. A golf club bag according to claim 20, wherein the said shaped elongate recesses are arranged substantially radially.

23. A golf club bag according to claim 20, wherein the said bottom shaft-retaining means comprises an arcuate tube comprising circular hollow sub-sections to accommodate the respective shafts of the seven irons, and waisted portions linking the said hollow sub-sections together.

24. A golf club bag according to claim 20 which has been loaded with a set of inverted golf clubs.

* * * * *